US008384608B2

(12) United States Patent
DeJean

(10) Patent No.: US 8,384,608 B2
(45) Date of Patent: Feb. 26, 2013

(54) SLOT ANTENNA

(75) Inventor: Gerald R. DeJean, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 445 days.

(21) Appl. No.: 12/789,471

(22) Filed: May 28, 2010

(65) Prior Publication Data

US 2011/0291901 A1 Dec. 1, 2011

(51) Int. Cl.
*H01Q 13/10* (2006.01)

(52) U.S. Cl. ..... 343/770; 343/767

(58) Field of Classification Search ..... 343/700 MS, 343/767, 770

See application file for complete search history.

(56) References Cited

U.S. PATENT DOCUMENTS

| | | | | |
|---|---|---|---|---|
| 5,241,322 | A * | 8/1993 | Gegan | 343/700 MS |
| 5,926,137 | A | 7/1999 | Nealy | |
| 6,459,414 | B1 | 10/2002 | Levis et al. | |
| 7,019,697 | B2 | 3/2006 | du Toit | |
| 7,027,001 | B2 * | 4/2006 | Thudor et al. | 343/769 |
| 7,050,013 | B2 * | 5/2006 | Kim et al. | 343/770 |
| 7,061,442 | B1 * | 6/2006 | Tang et al. | 343/767 |
| 7,161,537 | B2 | 1/2007 | Rafi et al. | |
| 7,498,987 | B2 * | 3/2009 | Svigelj et al. | 343/700 MS |
| 8,121,544 | B2 * | 2/2012 | Shimizu et al. | 455/41.1 |
| 2007/0241983 | A1 | 10/2007 | Cao et al. | |

OTHER PUBLICATIONS

Phillips, Eliot., "How-To: Build a WiFi biquad dish antenna", Retrieved at << http://www.engadget.com/2005/11/15/how-to-build-a-wifi-biquad-dish-antenna >>, Nov. 15, 2005, pp. 1-7.

Sharma, et al., "Diagonal Slotted Diamond Shaped Dual Circularly Polarized Microstrip Patch Antenna with Dumbbell Aperture Coupling", Retrieved at << http://ieeexplore.ieee.org/stamp/stamp.jsp?tp=&arnumber=1617757&userType=inst >>, pp. 4.

Wang, et al., "A Novel Array Formed by Diamond Antennas with High Isolation for Base Station Applications", Retrieved at << http://ieeexplore.ieee.org/stamp/stamp.jsp?arnumber=05195679 >>, ICWMMN2006 Proceedings A Novel Array Formed by Diamond Antennas with High Isolation for Base Station Applications, Nov. 6-9, 2006, pp. 1-3.

Tham, et al., "Diamond-shaped broadband slot antenna", Retrieved at << http://ieeexplore.ieee.org/Xplore/login.jsp?url=http%3A%2F%2Fieeexplore.ieee.org%2Fiel5%2F9880%2F31412%2F01461109.pdf%3Farnumber%3D1461109&authDecision=-203 >>, Antenna Technology: Small Antennas and Novel Metamaterials, 2005, IWAT 2005. IEEE International Workshop on, Mar. 7-9, 2005, pp. 431-434.

* cited by examiner

*Primary Examiner* — Tho G Phan

(57) ABSTRACT

Technology is described for a slot antenna. The slot antenna can include a substrate having a metal layer on a first side of the substrate. A feed line can be located on a second side of the substrate. A first polygon shaped slot can be formed in the metal layer of a first side of the substrate. A second polygon shaped slot can also be formed in the metal layer of the first side of the substrate. The second polygon shaped slot can be recessed within a perimeter of the first polygon shaped slot and the second polygon shaped slot and first polygon shaped slot share a common side. Examples of the first and second polygon shapes may include square or diamond shapes.

20 Claims, 7 Drawing Sheets

SLOT ANTENNA

BACKGROUND

Over the past fifteen years, there has been significant research performed in the area of planar antenna design. Initially, this research was directed toward the development of an understanding of the many parameters influencing the operation of planar antennas. Modifications to certain parameters can provide performance improvements in radiation pattern revitalization, increasing gain, shrinking size, increasing bandwidth, or making the antenna structure more compact.

Although many of these topics are still being researched, some emphasis has been placed on making the antenna more compact in recent years. This is because consumer demand has called for electronic components to be smaller in order for electronic devices to be portable and integrated together into a multifunctional device with many features. In the current electronics market, simple devices that perform just one function are rarely seen. As a result, smaller antennas that can be used in multi-function devices are being investigated.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. While certain disadvantages of prior technologies are noted in this disclosure, the claimed subject matter is not to be limited to implementations that solve any or all of the noted disadvantages of the prior technologies.

Various embodiments are described for a slot antenna. The slot antenna can include a substrate having a metal layer on a first side of the substrate. A feed line can be located on a second side of the substrate. A first polygon shaped slot can be formed in a metal layer on a first side of the substrate. A second polygon shaped slot can also be formed in a metal layer on the first side of the substrate. The second polygon shaped slot can be recessed within a perimeter of the first polygon shaped slot, and the second polygon shaped slot and first polygon shaped slot can share a common side. Examples of the first and second polygon shapes may include square or diamond shapes.

An example embodiment of a method for making a slot antenna is described. The method can include the operation of applying a metal layer to a first side of a substrate. A first polygon shaped slot can be formed into a metal layer on the first side of the substrate. The polygon shaped slot may be cut, embossed, etched, or otherwise formed into a metal layer on the substrate. A second polygon shaped slot can be formed into a metal layer on the first side of the substrate recessed within a perimeter of the first polygon shaped slot. The second polygon shaped slot and first polygon shaped slot can share at least one common slot side. A metal trace can be applied to the second side of the substrate to form a feed line oriented perpendicular to a side of the first polygon shaped slot.

DETAILED DESCRIPTION

Figure 1A:
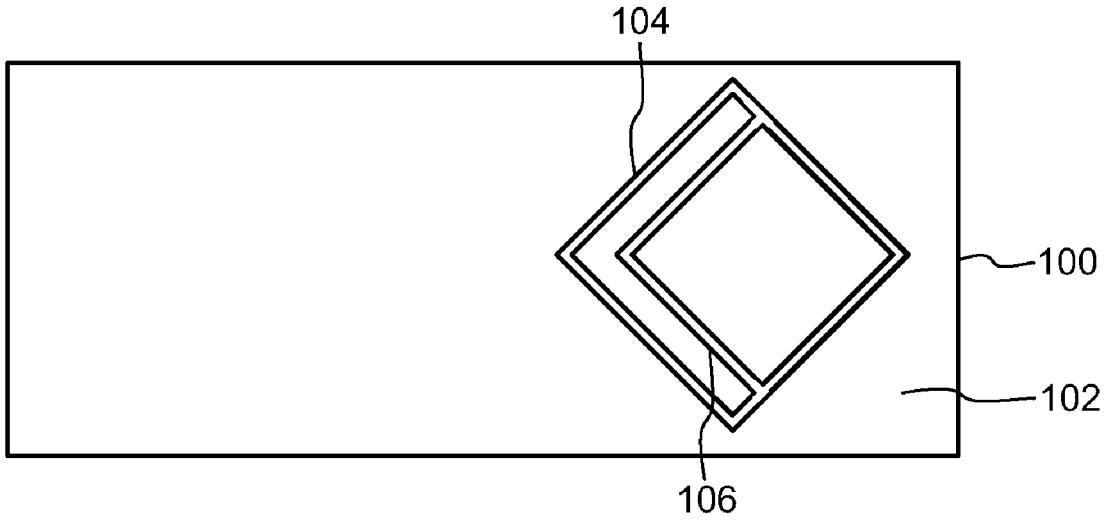
FIG. 1A is a diagram illustrating an embodiment of a slotted portion of an antenna in a substrate.

Reference will now be made to the exemplary embodiments illustrated in the drawings, and specific language will be used herein to describe the same. It will nevertheless be understood that no limitation of the scope of the technology is thereby intended. Alterations and further modifications of the features illustrated herein, and additional applications of the embodiments as illustrated herein, which would occur to one skilled in the relevant art and having possession of this disclosure, are to be considered within the scope of the description.

The technology disclosed includes a planar antenna designed for substrates or printed circuit boards (PCBs) in which the positioning and the space are limited or restricted for the antenna. The planar antenna described can provide adequate bandwidth, gain, and frequency control for certain communication applications. In one example, a dual-polarized double polygon slot antenna can be used for bandwidth and gain enhancement on smaller sized substrates in which the antenna is confined to a relatively small space on the board. The configuration of the described antennas enables easier integration of an antenna with the substrate without the need to modify other circuitry on the printed circuit board. In a transmitting or receiving mode, the feed lines allow for two polarizations to be excited individually based on the alignment of the receiving or transmitting antenna.

A slot portion of a slot antenna is shown in FIG. 1A. The antenna structure can include a substrate 100 having a metal layer 102 on a first side of the substrate. The metal layer may include tin, copper, silver, gold, platinum or another conductive metal or alloy. A first polygon shaped slot 104 can be formed into the metal layer on a first side of the substrate. The substrate can be a printed circuit board and the metal layer can form a ground plane on the substrate into which the first polygon shaped slot is formed. The first polygon may be diamond shaped as illustrated in FIG. 1A. Other polygon shapes can be used for the slot, as will be illustrated later.

A second polygon shaped slot 106 can be formed into a metal layer on the first side of the substrate. The second polygon shaped slot can be recessed within a perimeter of the first polygon shaped slot. The second polygon can be diamond shaped or another polygon shape that is the same or in some cases different than the first polygon shape.

In addition, the second polygon shaped slot and first polygon shaped slot can share at least one common side. For example, the second polygon shaped slot and first polygon shaped slot can share two sides of a polygon shape, and the two shared sides of the polygon shapes can form part of an outer slot or perimeter. The first polygon shaped slot and the second polygon shaped slot may be formed by cutting a slot through the metal layer 102 or ground plane. The slot may also be formed by etching a slot into the metal layer, die stamping a slot into the metal layer when the substrate is being manufactured, avoiding placing metal in a desired polygon shape, or the slots can be created in other ways that provide the desired slot or channel in the metal layer. The slot may also pass into the substrate or printed circuit board to some defined depth (e.g., a minimal depth). Generally, the slot may not pass all the way through the printed circuit board. Thus, the ground plane can have two interrelated polygon-shaped slots in the ground plane for radiation of a wireless signal.

Figure 1B:
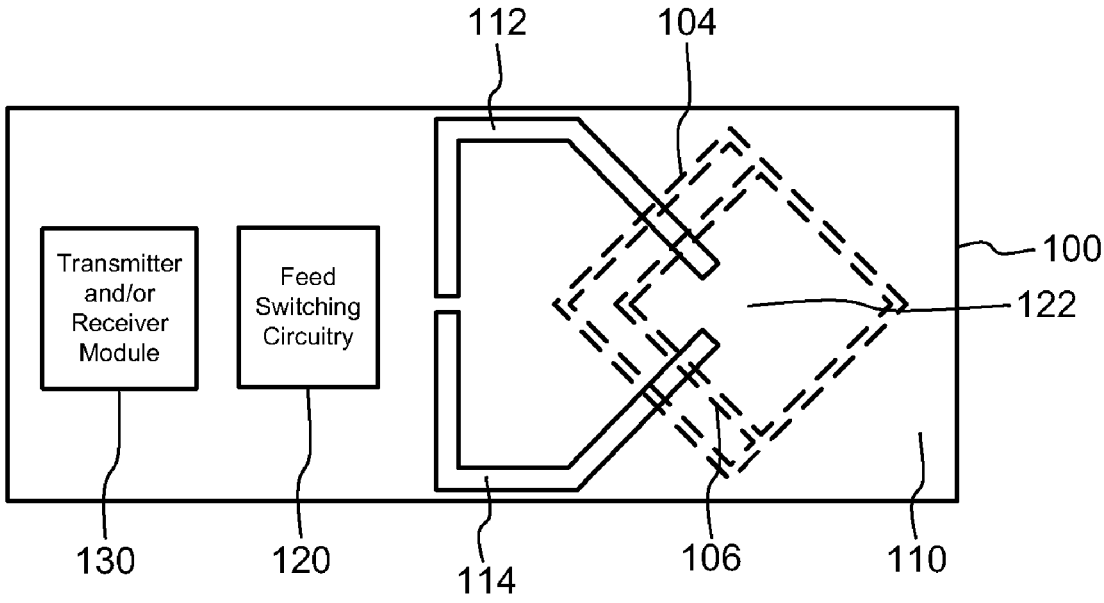
FIG. 1B is a diagram illustrating an embodiment of a slot antenna where the lead lines are illustrated with respect to polygon shaped slots.

FIG. 1B illustrates an opposite side of a substrate for a slot antenna. At least one feed line 112 can be provided on this second side of the substrate 110. In addition, a second feed line 114 may be included. The feed lines can be on the opposite side (e.g., backside) of the ground plane and the feed lines can be metal traces applied to the substrate or printed circuit board. The metal traces may be tin, copper, silver, gold, platinum or another conductive metal or alloy. The first and second polygon shaped slots are shown as dotted lines because the slots typically cannot be seen through the opaque substrate. However, double polygon slots are illustrated in dotted lines to show the alignment of the feed lines with the double polygon shaped slots.

In one example configuration, the first feed line and second feed line on a second side of the substrate can be oriented at an angle to a side of the first polygon shaped slot and/or second polygon shaped slot. For example, the first and second feed lines may be formed at an angle perpendicular to the sides of the polygon shaped slots. In other words, the feed lines may pass by (e.g., pass under) the slots at a 90 degree angle. The first feed line may be perpendicular to one side of the first polygon shaped slot and the second feed line may be perpendicular to a second side of the first polygon shaped slot.

The two feed lines can allow two polarizations of the antenna output to be excited independently. In addition, feed switching circuitry 120 can be included that enables switching between the two feed lines to create the two polarizations. The feeding points of the feed lines may be located close together in order to connect the terminals of the feed switching circuitry. The feed switching circuitry can be a switch, a PIN diode, other transistor switching circuitry, or another feed network capable of switching between the two feed lines. The switch, the PIN diode or other feed circuitry can serve as the switching mechanism to determine which antenna polarization is excited. A transmitter and/or receiver module 130 for generating and receiving RF signals can also be located on the substrate or ground plane, if desired.

The positions of the slots may be varied to maximize the bandwidth, gain, and frequency of operation of the design. Being able to vary the positions of the slots is useful due to the fact that as the desire increases for devices to become smaller, the number of parameters that can be controlled in an antenna may decrease in response to the reduced size. The use of the ground plane as the actual antenna in the present technology can also mean that a patch is not needed to be used in this antenna. In many past wireless antenna designs, when a feed line is placed below the ground plane, a slot is loaded into the ground plane so energy can be transferred from the feed line to a patch above the ground plane for radiation. No patch is needed in this described antenna. Avoiding a patch above the ground plane can result in millions of dollars of savings in wireless device production over the manufacturing lifetime of the antenna.

The first polygon shaped slot and second polygon shaped slot may be oriented at an angle with respect to an edge of the substrate. The first and second polygon shaped slots may be oriented at an angle of between zero and 90 degrees with respect the edge of the substrate. The polygons can be angled in order to accommodate the varying angles of other antennas and devices that are communicating using the slotted antenna. For example, the first and second polygon shaped slots are oriented at a 45 degree angle with respect to an edge of the substrate in FIGS. 1A and 1B.

The second polygon shaped slot can have a central region 122, as in FIG. 1B, and a first feed line can cross into the central region. In addition, the second feed line can also cross into the central region. The location of the feed lines aid in driving both of the polygon shaped slots to create electromagnetic transmissions in the radio frequency (RF) band.

An example implementation of a double polygon antenna as illustrated by the stack-up design in FIG. 1B from the top of the structure (the slot-loaded ground plane) to the bottom of the structure with the feed lines will now be described. The substrate material may be FR-4 which is the international grade designation for fiberglass reinforced epoxy laminates that are flame retardant. FR-4 (FR4) is widely used as a base insulator and mounting structure for printed circuit boards. FR-4 can have a dielectric constant ($\in_r$) of 4.45±0.25 and a loss tangent (tan δ) of 0.025. The thickness for the substrate may be 39 mils. The thickness for the copper (Cu) traces may be 1.4 mils. The traces can include the feed lines and the ground plane. The feed lines may be 71 mils wide in order to provide a 50 ohm input without significant discontinuities.

Additionally, companies are always interested in reducing costs when products are planned for mass production. Hence, using cost effective components and substrates is valuable. FR-4 is one of the most inexpensive substrates used in production, but this substrate has been typically considered a substrate with poor qualities for coupling energy from feed lines to the antenna as well as radiating energy through the antenna's radiating slots due to the relatively high substrate loss (tan δ=0.025). The disclosed technology can be effective even with low cost materials such as FR-4. However, any type of substrate or printed circuit board can be used in the antenna disclosed. When a substrate with better radiating qualities is used, then the performance of the antenna may even be increased. Furthermore, by eliminating the use of a patch as in some previous antenna designs and having the slot-loaded ground plane act as the radiator, the overall antenna cost may be significantly decreased.

There have been many planar antenna configurations that have been proposed through the years that incorporate FR-4 substrates. A majority of these configurations have focused on monopole (or dipole) antenna or patch antenna design. There are some drawbacks from using each of these two approaches. In monopole designs, the feed line typically rests on the same layer as the radiating element. This can make the antenna design's size extend longer in the plane of the design. In addition, shielding may become necessary when the feed lines are greater than a certain width because feed line radiation can potentially degrade the performance of the antenna.

As a result, the feed lines can be placed below the ground plane as a way to facilitate better shielding at microwave frequencies.

In patch designs, when the feed line is placed on the same layer as the radiating element, the same problems of lateral space conservation and shielding can be a concern. To get around these potential design limitations, vertically stacking components on top of each other may be utilized since the thickness of a component is usually a small fraction of the components' lateral dimensions. In the present technology, aperture coupling (which consist of placing the feed lines below the ground plane and the radiating element above the ground plane) may allow shielding and "in-plane" space conservation to be preserved.

In some implementations, there may be a lack of printed circuit board space for the structure. As a result, a useful feeding configuration is along the diagonals of the patch. Feeding the signal along the diagonals can help maintain symmetry with respect to an imaginary horizontal line that runs along the middle of the printed circuit board. When symmetry is maintained for dually-polarized designs, the antenna performance may be nearly the same for both feeds. Dual polarization can help maintain a good link between a host device and a peripheral device regardless of either device's antenna orientation. The double polygon slot may be placed on the right side of the ground plane to preserve space for circuitry on the opposite side of the ground plane area (or vice-versa). This shape for the slot can provide valuable gain, bandwidth, and frequency selection for this dually-polarized configuration. The illustrated shape can help maximize the energy transmitted through the feed lines.

Since the ends of the feed lines may be placed at an angle for space conservation, the lengths of the slot can be at an angle to the lengths of the end of the feed lines. By using the single slot, an absolute desired bandwidth can be covered but the gain may drop from the low edge to the high edge of the RF band. For instance, if an approximately 150 MHz band is covered by the single slot (depending on the widths of the slot and lengths of the feed line) then there may be an about 1.2 dB drop in power across the band. When the width of the slot is increased, the drop in gain can be maintained, but the impedance matching performance may be degraded. To improve the constant gain of the antenna while maintaining an acceptable bandwidth, a second smaller slot can be placed inside the first slot. By using this second slot, a second higher frequency mode is introduced that has a larger bandwidth than the mode of the first slot alone. In the example of the 150 MHz band for the first slot, an approximately 200 MHz band can be introduced with the second slot, depending on the slot widths and feed line lengths. In addition, an improvement in the antenna gain that is more stable across the frequency band is observed due to the existence of this second slot.

Figure 2:
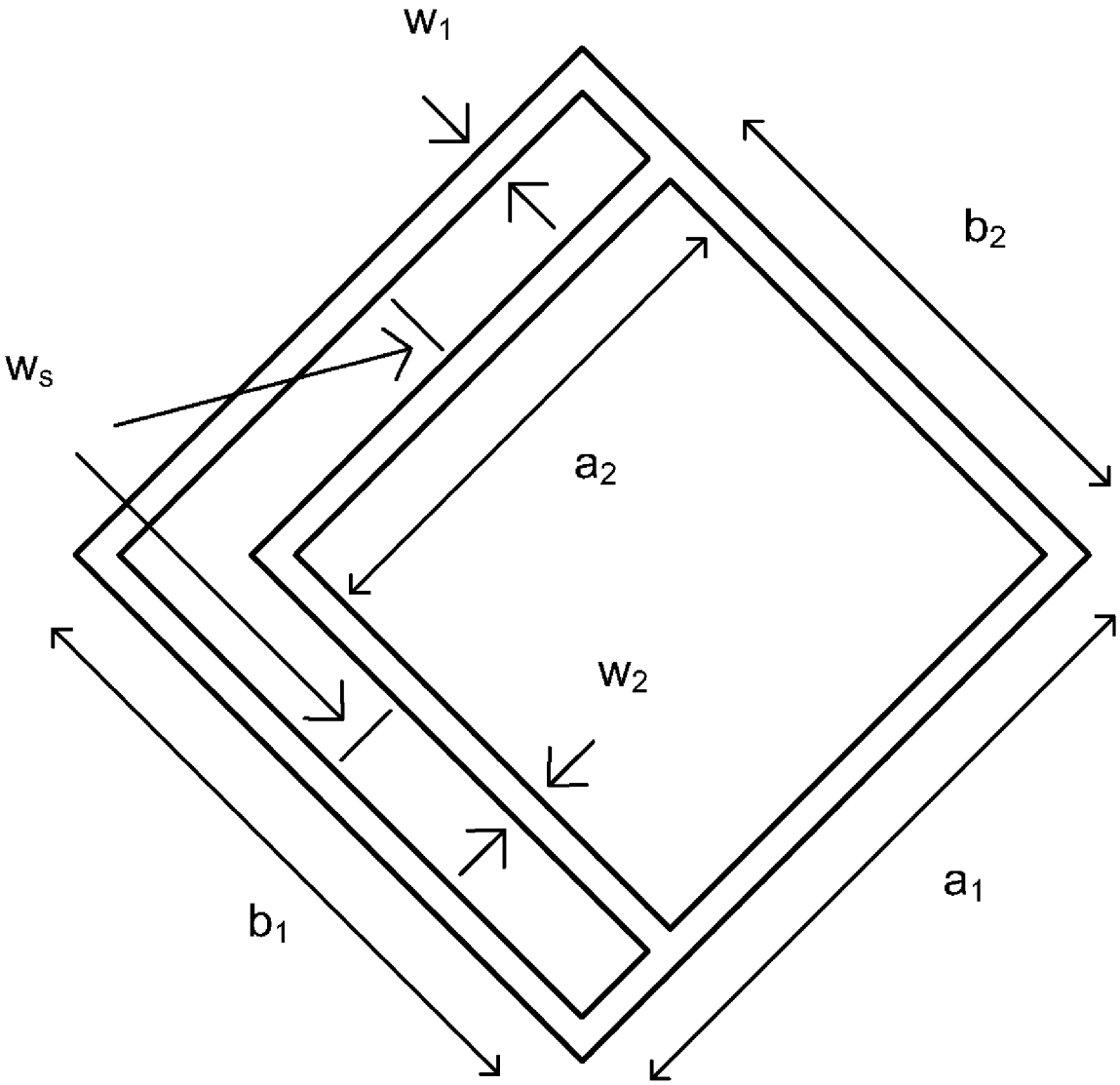
FIG. 2 is a diagram illustrating an embodiment of a slot antenna with example relative dimensions.

FIG. 2 illustrates some example relative dimensions for a double polygon slot antenna, more specifically one in a double diamond or rotated double square configuration.

The $a_1$, $b_1$, $a_2$, and $b_2$ parameters are the lengths and widths of the inner perimeters of the first and second slot, respectively, that form the double polygon slot. In this case, since the perimeter is the shape of a square, $a_1=b_1$ and $a_2=b_2$. Additionally, the inner perimeter sides of the first slot are equal to $a_1$, and those of the second slot are equal to $a_2$. The $a_2$ and $b_2$ parameters can be smaller in value than the $a_1$ and $b_1$ parameters.

The $w_1$ and $w_2$ parameters represent the widths of the first and second slots, respectively, and these widths are maintained throughout the slots' lengths. Further, the $w_s$ parameter is the distance between the first and second polygon slot shapes on one or more sides. The $w_s$ gap distance between the first polygon shaped slot and second polygon shaped slot can be sized to provide a higher and lower frequency resonance in the antenna.

The $a_2$ and $b_2$ parameters can shift the frequency to the desired radio frequency band. The modification of the $a_2$ and $b_2$ parameters can represent the modification of the control parameters that control the higher mode resonance of the second slot. Decreasing these parameters can reduce the size of the second polygon shaped slot and lower the frequency, while increasing these parameters can have the opposite effect. The $a_2$ and $b_2$ parameters can be used to establish a strong resonance at a frequency that is desired for operation and communications.

The $a_1$ and $b_1$ parameters can affect the first polygon shaped slot and can also establish a strong resonance at a frequency that can be lower than that established by the $a_2$ and $b_2$ parameters. In some situations, when the numeric values of $a_1$ and $b_1$ are close enough to the values of $a_2$ and $b_2$, problems may be created. The lower frequency resonance has a smaller bandwidth that is less suitable for operation alone, and this is one reason why the resonant behavior of the second slot is desired. To maintain frequency separation, the value of $w_s$ can be optimized to separate the frequencies of the two resonances by a suitable frequency value. A second way of mitigating the effect of the first resonance deals with the use of parameters $w_1$ and $w_2$. Both parameters can be adjusted to improve the matching performance of the antenna. In one example, the value of the $w_1$ parameter can be made small relative to that of the $w_2$ parameter. A slot with a small width does not allow as much energy to be resonated. As a result, the resonance of the first slot may no longer be as strong and may be diminished enough to avoid interference with the resonance of the second slot.

Figure 3:
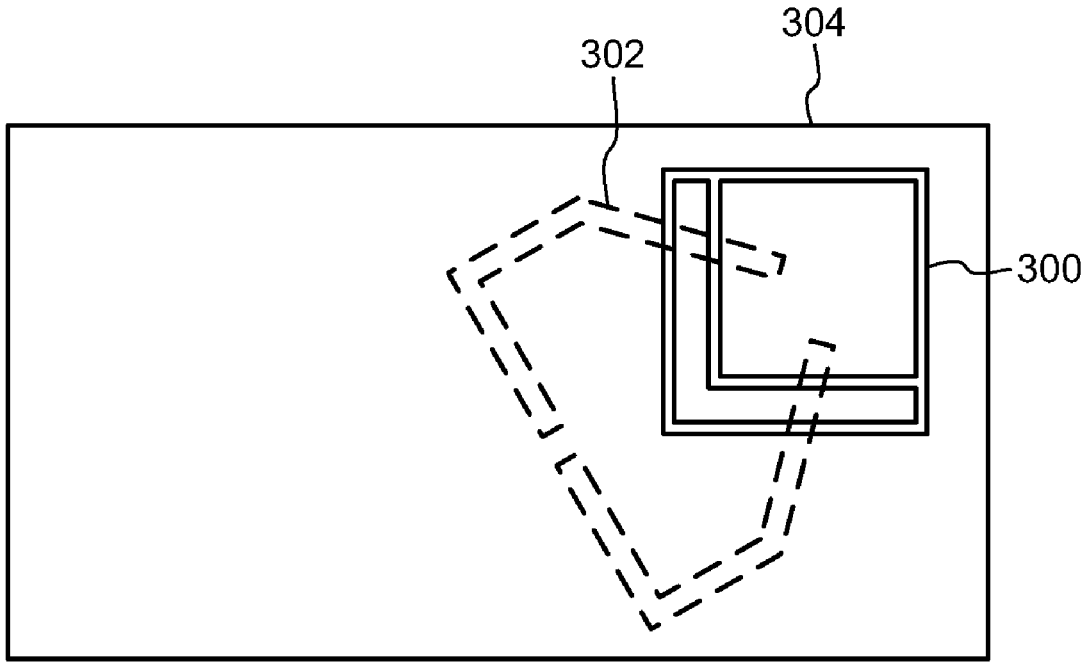
FIG. 3 is a diagram illustrating an embodiment of a polygon slot antenna where the polygon antenna is oriented at a same angle as an edge of the substrate.

FIG. 3 illustrates an embodiment of a double polygon slotted antenna, where the antenna is not oriented at an angle with respect to the edges 304 of the substrate but the slots of the antenna are oriented at the same angle as the edge of the substrate (e.g., parallel orientation). As a result, the lead lines may also be rotated so the lead lines can cross into the slotted polygons at an angle. While the angle that the lead lines cross into the slotted polygons may be as illustrated, a 90 degree angle and other angles can be used as desired.

Figure 4A:
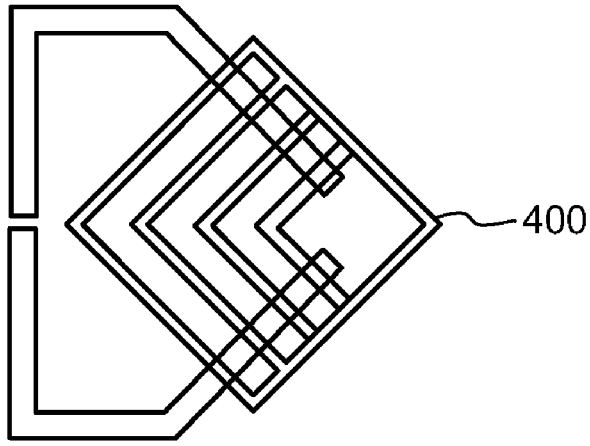
FIG. 4A is a diagram illustrating an embodiment of a polygon slot antenna where multiple smaller polygons are recessed within each previous larger polygon slot shape.

FIG. 4A illustrates an example embodiment of a polygon slotted antenna 400 where multiple smaller polygons are successively recessed within each previous larger polygon slotted shape. This repetitive shape allows additional bands to be added to the overall bands already being used. Providing additional bands can allow for additional bandwidth tuning as needed by a specific communication application.

Figure 4B:
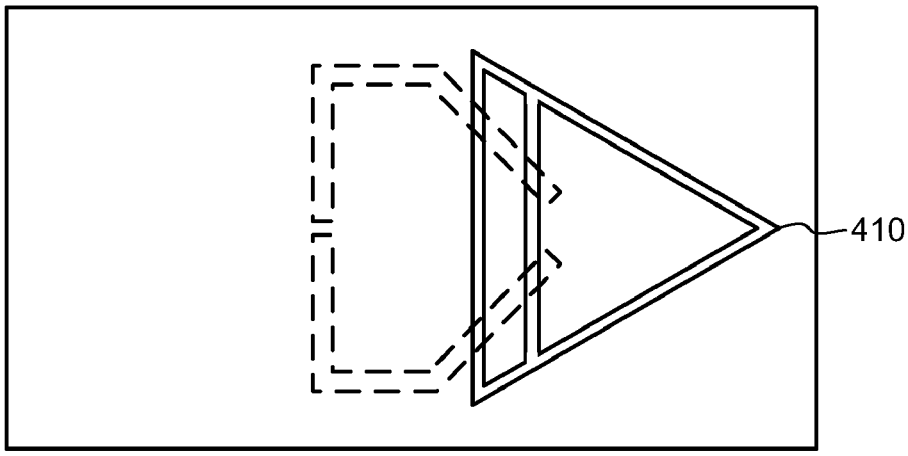
FIG. 4B illustrates an example embodiment of a slot antenna with triangular shaped slots.
Figure 4C:
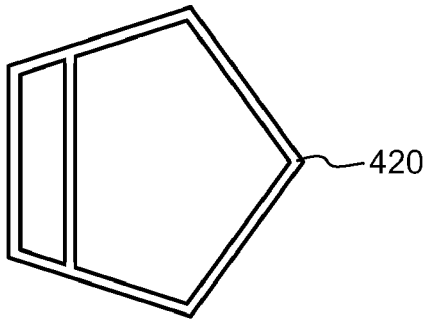
FIG. 4C illustrates a pentagonal shaped slot antenna.
Figure 4D:
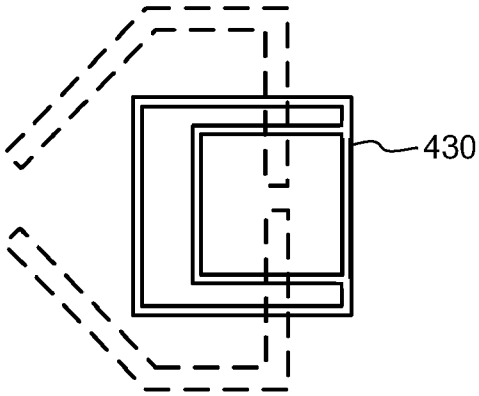
FIG. 4D illustrates a nested box slot antenna where the nested boxes share one common side.
Figure 4E:
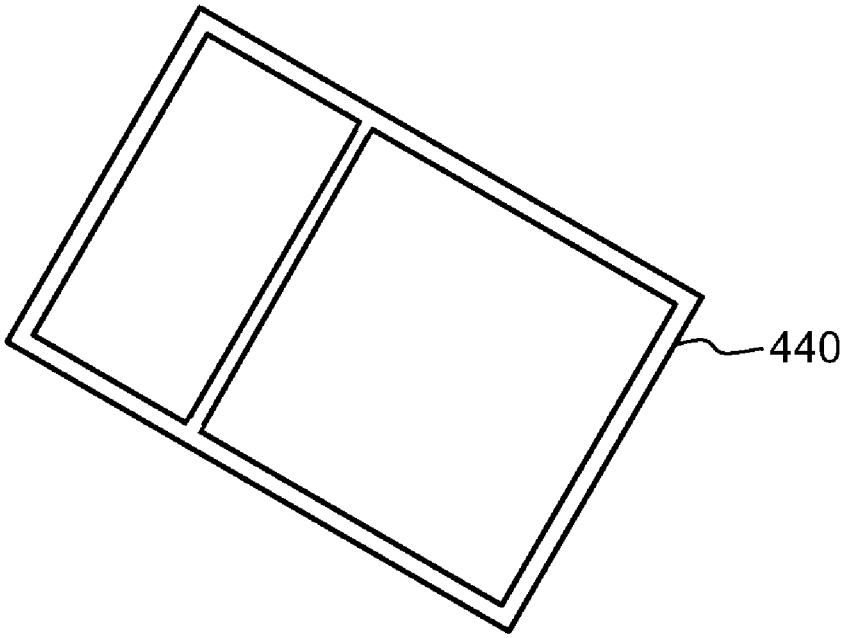
FIG. 4E illustrates an embodiment of a rectangle used for asymmetric slots in the antenna.
Figure 4F:
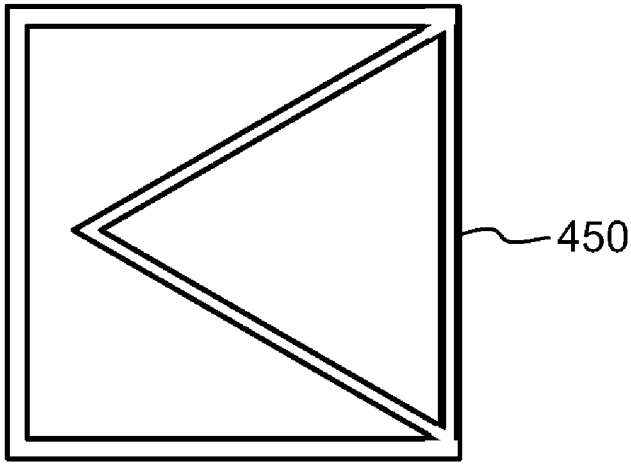
FIG. 4F illustrates an embodiment of a triangle in a square used for the slots in the antenna.

FIG. 4B illustrates an example embodiment of a slotted antenna with triangular shaped slots 410 where the lead lines can enter from one side of the nested triangle shapes. The lead lines may also enter the triangle from the other two sides if desired. FIG. 4C illustrates a nested pentagonal shaped slot antenna 420 that can be formed in the metal layer of the printed circuit board. FIG. 4D illustrates a nested box slot antenna 430 where the nested boxes share one common side. FIG. 4E illustrates a rectangle 440 used for asymmetrically shaped slots in the antenna. FIG. 4F illustrates a triangle in a square used for the slots in the antenna.

Any additional type of polygon shape can be used for the slotted shapes in the antenna. The shapes can include hexagons, heptagons, octagons, 5-sided stars, 6-sided stars, 7-sided stars and irregularly shaped polygons which may be used in the nested slotted antenna design. The polygon shapes can share one, two or more sides of the polygon. In addition, the lead lines may enter the polygons at an angle perpendicular to the polygon sides or some other selected angle.

Figure 5:
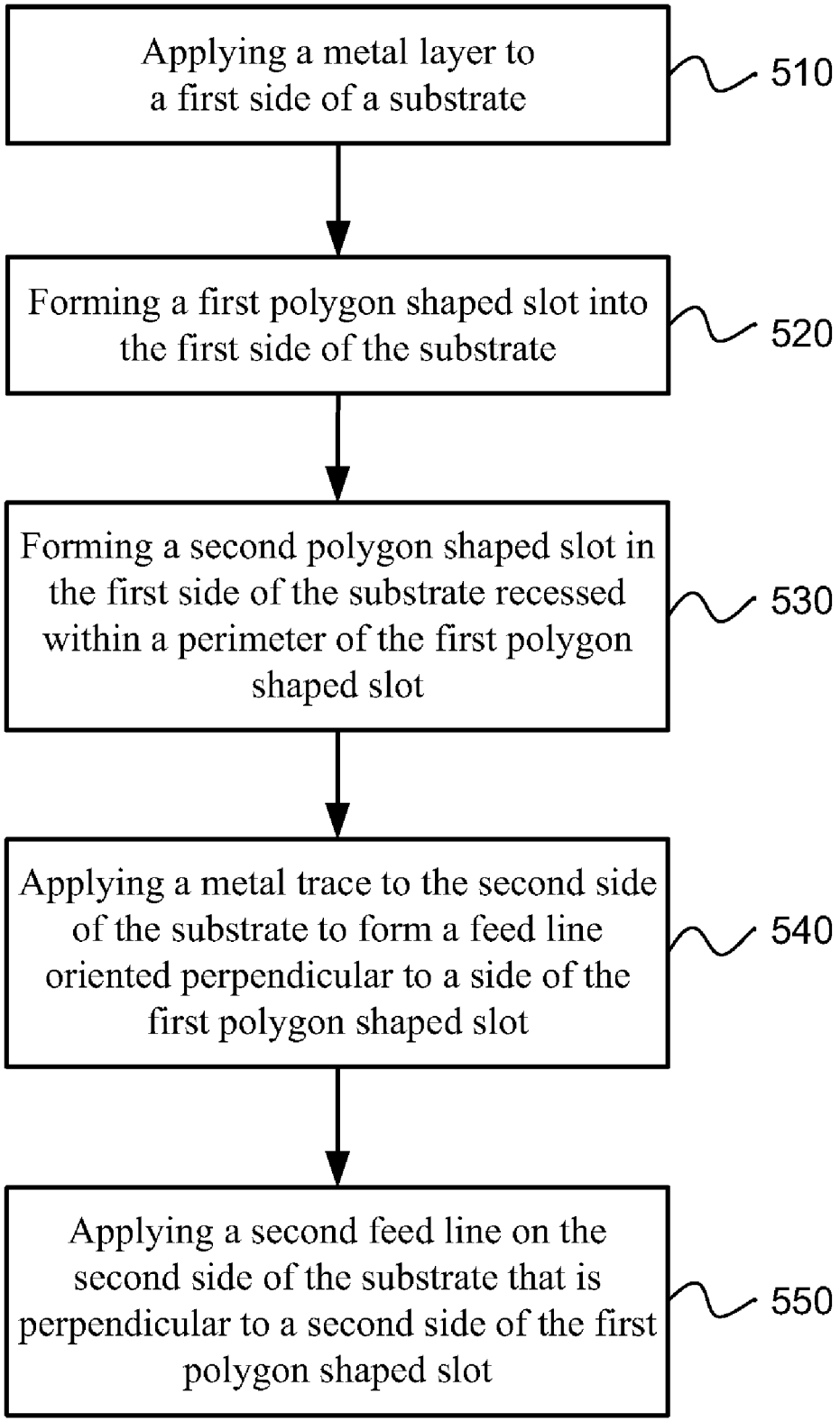
FIG. 5 is flowchart illustrating an embodiment of a method making a polygon slot antenna.

FIG. 5 illustrates a method for making a slot antenna. The method can include the operation of applying a metal layer to a first side of a substrate, as in block 510. A first polygon shaped slot can be formed into a metal layer on the first side of the substrate, as in block 520. A second polygon shaped slot can also be formed in a metal layer on the first side of the substrate, as in block 530. The second polygon shape can be recessed within a perimeter of the first polygon shaped slot. In addition, the second polygon shaped slot and first polygon shaped slot may share two common slot sides or a common slot channel at some points of the first polygon shaped slot.

Figure 6:
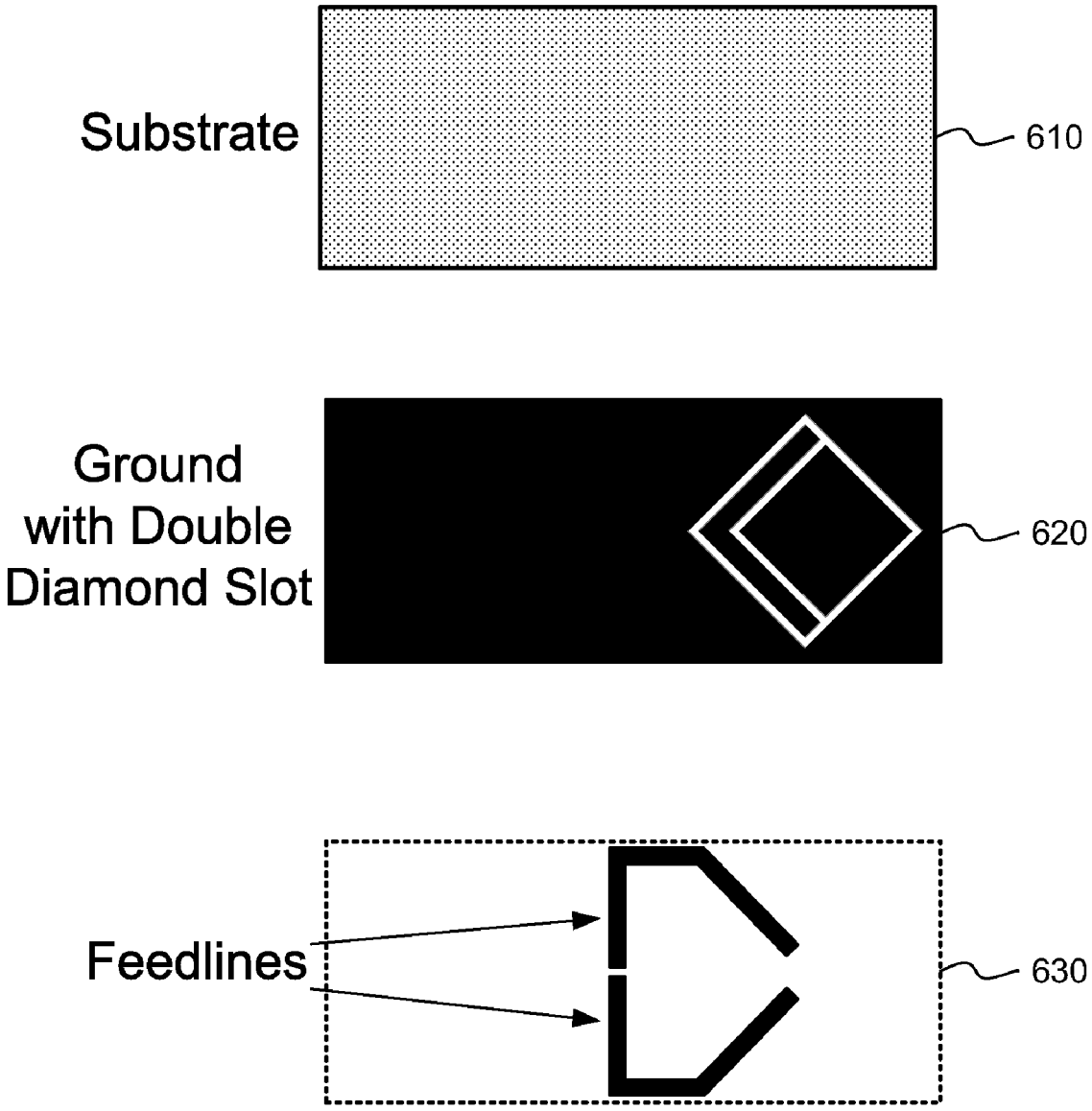
FIG. 6 illustrates the results of operations applied to a substrate using example fabrication operations.

FIG. 6 illustrates the results of steps applied to substrate in example manufacturing steps. When the process begins a substrate 610 can be provided. A metal layer may be applied to substrate which is represented as the black portion of the substrate 620. The metal layer may be mechanically dipped, sputtered or otherwise applied to the substrate. The first and second polygon slots can be formed or cut into the metal layer of the substrate and the slots are illustrated as the white polygons.

Returning to FIG. 5, a metal trace can be applied to the second side of the substrate to form a feed line, as in block 540. The feed line can be oriented perpendicular to a side of the first polygon shaped slot. A second feed line can be applied on the second side of the substrate that is perpendicular to a second side of the first polygon shaped slot, as in block 550. FIG. 6 further illustrates that two feed lines can be applied to an opposite side or a back side of the substrate 630.

One example use of this technology is the use of the antenna in gaming consoles or other gaming computing systems. Current gaming consoles not only provide a gaming experience, but also include wireless communication links for controller-to-console communications and internet communications through a wireless router or wireless connection point. Therefore, the antenna is a component that enables communication links between a console and peripheral devices (examples include Bluetooth, Wi-Fi, or proprietary wireless links). The present technology can provide an effective communication link between a gaming console and a user's peripheral device such as a controller, joystick, etc. Other example uses for the antenna can be in wireless routers, wireless phones, wireless remote controls, wireless mobile devices and other wireless communication devices.

Since the size of the printed circuit boards inside such wireless communication devices is decreasing, smaller antenna architectures that can function with the decreases in printed circuit board size are useful. In one example configuration, this antenna configuration can operate between 2.4-2.483 GHz which is the ISM (industrial, scientific and medical) band for Bluetooth and Wi-Fi connectivity. However, the antenna design is applicable to slot antennas at a wide range of operating frequencies. A dual-polarized double polygon slot antenna can be used for bandwidth and gain enhancement on small size substrates in which the antenna is confined to a small space on the board. The configuration of this slot antenna can be less difficult to integrate into a printed circuit board (PCB) and can avoid modifying other circuitry on the board.

This technology provides a planar antenna design to be formed in a metal layer on substrates in which the position may be fixed and the space may be limited. The planar antenna described can provide adequate bandwidth, gain, and frequency control for certain practical applications within the limited space and positioning.

Some of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more blocks of computer instructions, which may be organized as an object, procedure, or function. Nevertheless, the executables of an identified module need not be physically located together, but may comprise disparate instructions stored in different locations which comprise the module and achieve the stated purpose for the module when joined logically together.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices. The modules may be passive or active, including agents operable to perform desired functions.

Furthermore, the described features, structures, or characteristics may be combined in any suitable manner in one or more embodiments. In the preceding description, numerous specific details were provided, such as examples of various configurations to provide a thorough understanding of embodiments of the described technology. One skilled in the relevant art will recognize, however, that the technology can be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements can be devised without departing from the spirit and scope of the described technology.

The invention claimed is:

1. A slot antenna, comprising:

a substrate having a first side and a second side and a metal layer on the first side of the substrate;

a feed line on the second side of the substrate;

a first polygon shaped slot formed in the metal layer of the first side of the substrate; and a second polygon shaped slot formed in the metal layer of the first side of the substrate, wherein the second polygon shaped slot is recessed within the first polygon shaped slot, and wherein the second polygon shaped slot and the first polygon shaped slot share a common side.

2. The slot antenna as in claim 1, wherein the second polygon shaped slot and the first polygon shaped slot share two sides of a polygon shape forming a portion of an outer slot.

3. The slot antenna as in claim 1, wherein the feed line is further oriented at an angle perpendicular to a side of the first polygon shaped slot.

4. The slot antenna as in claim 1, wherein the first polygon shaped slot and the second polygon shaped slot are oriented at an angle with respect to an edge of the substrate.

5. The slot antenna as in claim 1, wherein the first polygon shaped slot and the second polygon shaped slot are oriented at a 45 degree angle with respect to an edge of the substrate.

6. The slot antenna as in claim 1, wherein the feed line further comprises two feed lines.

7. The slot antenna as in claim 6, wherein a first feed line is oriented perpendicular to a first side of the first polygon shaped slot and a second feed line is oriented perpendicular to a second side of the first polygon shaped slot.

8. The slot antenna as in claim 6, wherein the two feed lines allow two polarizations to be excited independently.

9. The slot antenna as in claim 8, further comprising a feed switching circuitry that enables switching between the two feed lines to create the two polarizations.

10. The slot antenna as in claim 1, wherein the second polygon shaped slot has a central region and the feed line crosses into the central region.

11. The slot antenna as in claim 1, wherein a gap distance between the first polygon shaped slot and the second polygon shaped slot is sized to provide a higher and lower frequency resonance.

12. The slot antenna as in claim 1, wherein the substrate is a printed circuit board.

13. A slot antenna, comprising:

a substrate having a first side and second side;

a metal layer on the first side of the substrate;

a first polygon shaped slot formed in the metal layer of the first side of the substrate;

a second polygon shaped slot formed in the metal layer of the first side of the substrate, wherein the second polygon shaped slot is recessed within a perimeter of the first polygon shaped slot and the second polygon shaped slot and first polygon shaped slot share two common slot sides;

a first feed line on the second side of the substrate that is oriented perpendicular to a side of the first polygon shaped slot; and a second feed line on the second side of the substrate that is perpendicular to a second side of the first polygon shaped slot.

14. The slot antenna as in claim 13, wherein the first polygon shaped slot and the second polygon shaped slot are oriented at a 45 degree angle with respect to an edge of the substrate.

15. The slot antenna as in claim 13, wherein the first feed line and the second feed line allow two polarizations to be excited independently.

16. The slot antenna as in claim 15, further comprising feed circuitry that enables switching between the first feed line and the second feed line to create the two polarizations.

17. The slot antenna as in claim 13, wherein the second polygon shaped slot has a central region and the first feed line and the second feed line cross into the central region.

18. The slot antenna as in claim 13, wherein a gap distance between the first polygon shaped slot and the second polygon shaped slot is provided so as to provide a higher and lower frequency resonance.

19. A method for making a slot antenna, comprising:

applying a metal layer to a first side of a substrate;

forming a first polygon shaped slot in the metal layer of the first side of the substrate;

forming a second polygon shaped slot in the metal layer of the first side of the substrate, the second polygon shaped slot being recessed within a perimeter of the first polygon shaped slot, wherein the second polygon shaped slot and the first polygon shaped slot share two common slot sides; and applying a metal trace to a second side of the substrate to form a feed line oriented perpendicular to a side of the first polygon shaped slot.

20. The method as in claim 19, further comprising applying a second feed line on the second side of the substrate that is perpendicular to a second side of the first polygon shaped slot.

* * * * *